US010989424B2

(12) United States Patent
Deng et al.

(10) Patent No.: US 10,989,424 B2
(45) Date of Patent: Apr. 27, 2021

(54) ATOMIZATION HUMIDIFIER

(71) Applicant: SHENZHEN QIANHAI PATUOXUN NETWORK AND TECHNOLOGY CO., LTD., Shenzhen (CN)

(72) Inventors: Shaowei Deng, Shenzhen (CN); Zezhi Jing, Shenzhen (CN); Tao Zhao, Shenzhen (CN)

(73) Assignee: SHENZHEN QIANHAI PATUOXUN NETWORK AND TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/739,141

(22) Filed: Jan. 10, 2020

(65) Prior Publication Data

US 2020/0149758 A1 May 14, 2020

Related U.S. Application Data

(63) Continuation of application No. PCT/CN2018/080737, filed on Mar. 27, 2018.

(30) Foreign Application Priority Data

Mar. 5, 2018 (CN) ..... 201820309011.1

(51) Int. Cl.
*F24F 6/12* (2006.01)
*F24F 6/14* (2006.01)

(52) U.S. Cl.
CPC ..... *F24F 6/12* (2013.01); *F24F 2006/143* (2013.01)

(58) Field of Classification Search
CPC ..... F24F 6/12; F24F 2006/143
USPC ..... 261/30, 81, DIG. 65
See application file for complete search history.

(56) References Cited

U.S. PATENT DOCUMENTS

2019/0321849 A1* 10/2019 Zu ..... B05B 1/002
2020/0096213 A1* 3/2020 Liang ..... F24F 6/12

FOREIGN PATENT DOCUMENTS

WO WO 2017/063257 A1 * 4/2017
WO WO 2019/169677 A1 * 9/2019

* cited by examiner

*Primary Examiner* — Charles S Bushey

(57) ABSTRACT

The present disclosure relates to a field of humidifiers and in particular to an atomization humidifier that increases an amount of vapor through a specially designed atomizing air channel. The atomization humidifier includes a main body and an atomizing chamber arranged in the main body. The atomizing chamber includes an atomizing generator. An atomizing air channel is arranged on the atomizing generator. A flow guide plate is obliquely arranged on a top end of the atomizing air channel. A water inlet is arranged on an upper end of the atomizing air channel. An opening of the water inlet is upward. A lower end of the atomizing air channel is an air guide tube with hollow vacancies. The atomization humidifier realizes water vapor concentration by setting the atomizing air channel arranged on the atomizing generator, which improves an atomizing efficiency of the atomization humidifier by optimized structure, and is low in cost and good in atomizing effect.

10 Claims, 3 Drawing Sheets

ATOMIZATION HUMIDIFIER

TECHNICAL HELD

The present disclosure relates to a field of humidifiers, and in particular to an atomization humidifier that increases an amount of vapor through a specially designed atomizing air channel.

BACKGROUND

Humidification products, currently on the market, are limited by technology and cost of an atomizing sheet, and it is difficult for an amount of vapor to satisfy the user's experience. In order to increase the amount of vapor, designers often use methods, such as increasing power consumption of the atomizing sheet and increasing air volume of a fan. However, these methods greatly increase production costs and use costs. In terms of structural design, most of humidifiers allow the vapor to diffuse in a water tank and the vapor is carried out through air convection. However, due to the confined space, a part of the vapor cannot be released from the water tank, which reduces atomization efficiency.

SUMMARY

Aiming at problems that the atomization efficiency of the current humidification products is low, the present disclosure provides an atomization humidifier with an optimized structure. The specific technical solution is as follows.

The present disclosure provides an atomization humidifier. The atomization humidifier includes a main body and an atomizing chamber arranged in the main body. The atomizing chamber includes an atomizing generator. An atomizing air channel is arranged on the atomizing generator. A flow guide plate is obliquely arranged on a top end of the atomizing air channel.

A water inlet is arranged on an upper end of the atomizing air channel. An opening of the water inlet is upward. A lower end of the atomizing air channel is an air guide tube with hollow vacancies.

In some embodiments, the flow guide plate includes a sawtooth portion. The sawtooth portion is strip-shaped triangular sawtooth protruding from a bottom surface of the flow guide plate. And a texture direction of the strip-shaped triangular sawtooth is an inclined direction of the flow guide plate.

In some embodiments, a portion of the flow guide plate corresponding to the water inlet extends downward to from a side wall of the flow guide plate. The side wall of the flow guide plate cooperates with the water inlet to fix the atomizing air channel and introduces water flows into the water inlet.

In some embodiments, the atomization humidifier further includes a housing. An air supply chamber is formed between the housing and an outer wall of the atomizing chamber.

In some embodiments, the air supply chamber includes an air inlet and an air outlet. A fan is arranged on the air inlet. The air outlet is arranged at the flow guide plate.

In some embodiments, a baffle corresponding to a vapor outlet of the atomization humidifier is arranged on the water inlet.

In some embodiments, gutters are provided in the air guide tube along an axial direction of the air guide tube.

In some embodiments, the gutters run through the air guide tube and are alternately arranged with the hollow vacancies along a peripheral direction of the air guide tube.

In some embodiments, the hollow vacancies are arranged at a lower side of the air guide tube. Air guide grooves are arranged on an upper side of the air guide tube corresponding to the hollow vacancies. The air guide grooves extend to a connection point of the air guide tube and the water inlet and protrude outward to form water blocking portions.

In some embodiments, partition plates are arranged on two sides of the gutters.

The atomization humidifier provided by the present disclosure realizes water vapor concentration of the atomization humidifier by setting the atomizing air channel arranged on the atomizing generator, which improves an atomizing efficiency of the atomization humidifier by optimized structure, and is low in cost and good in atomizing effect. The exquisite design of the atomizing air channel and the flow guide plate greatly reduces noise of the atomization humidifier and improves the user's experience.

1-Main body; 2-Atomizing chamber; 21-Atomizing generator; 22-Lower shell; 23-Upper shell; 3-Atomizing air channel; 31-Water inlet; 32-Air guide tube; 311-Slots; 312-Baffles; 321-Hollow vacancies; 322-Gutters; 323-Air guide grooves; 324-Water blocking portions; 4-Flow guide plate; 41-Sawtooth portion; 42-Side wall of the flow guide plate; 43-Buckle; 44-Air outlet; 5-Fan; 51-Ventilation hole; 52-Air inlet; 6-Air supply chamber; and 7-Vapor outlet.

DETAILED DESCRIPTION

In order to make objectives, technical solutions, and advantages of the present disclosure clearer, the present disclosure is further described in detail below with reference to the accompanying drawings and embodiments. It should be understood that the specific embodiments described herein are only used to explain the present disclosure and are not intended to limit the present disclosure.

In order to make the foregoing objects, features, and advantages of the present disclosure more comprehensible, specific embodiments of the present disclosure are described in detail below with reference to the accompanying drawings. Numerous specific details are set forth in the following description in order to fully understand the present disclosure. However, the present disclosure can be implemented in many other ways than those described herein, and those skilled in the art can make similar improvements without departing from the content of the present disclosure, and the present disclosure is not limited by the specific embodiments disclosed below.

In the description of the present disclosure, the meaning of "a plurality of" and "multiple" is at least two, for example, two, three, etc., unless it is explicitly stated and defined otherwise In the present disclosure, unless explicitly stated and defined otherwise, the first feature "arranged on" or "arranged below" the second feature may represent that the first feature directly contacts the second feature, or the first feature contacts the second feature through an intermediate medium. Moreover, the first feature is "above" the second feature means the first feature is directly above or obliquely above the second feature, or it only indicates that the first feature is horizontal higher than the second feature. The first feature is "below" the second feature means that the first feature is directly below or obliquely below the second feature, or it simply indicate that the first feature is horizontal lower than the second feature.

In addition, technical features involved in various embodiments of the present disclosure described below are able to be combined with each other as long as they do not conflict with each other.

Embodiment 1

Figure 1:
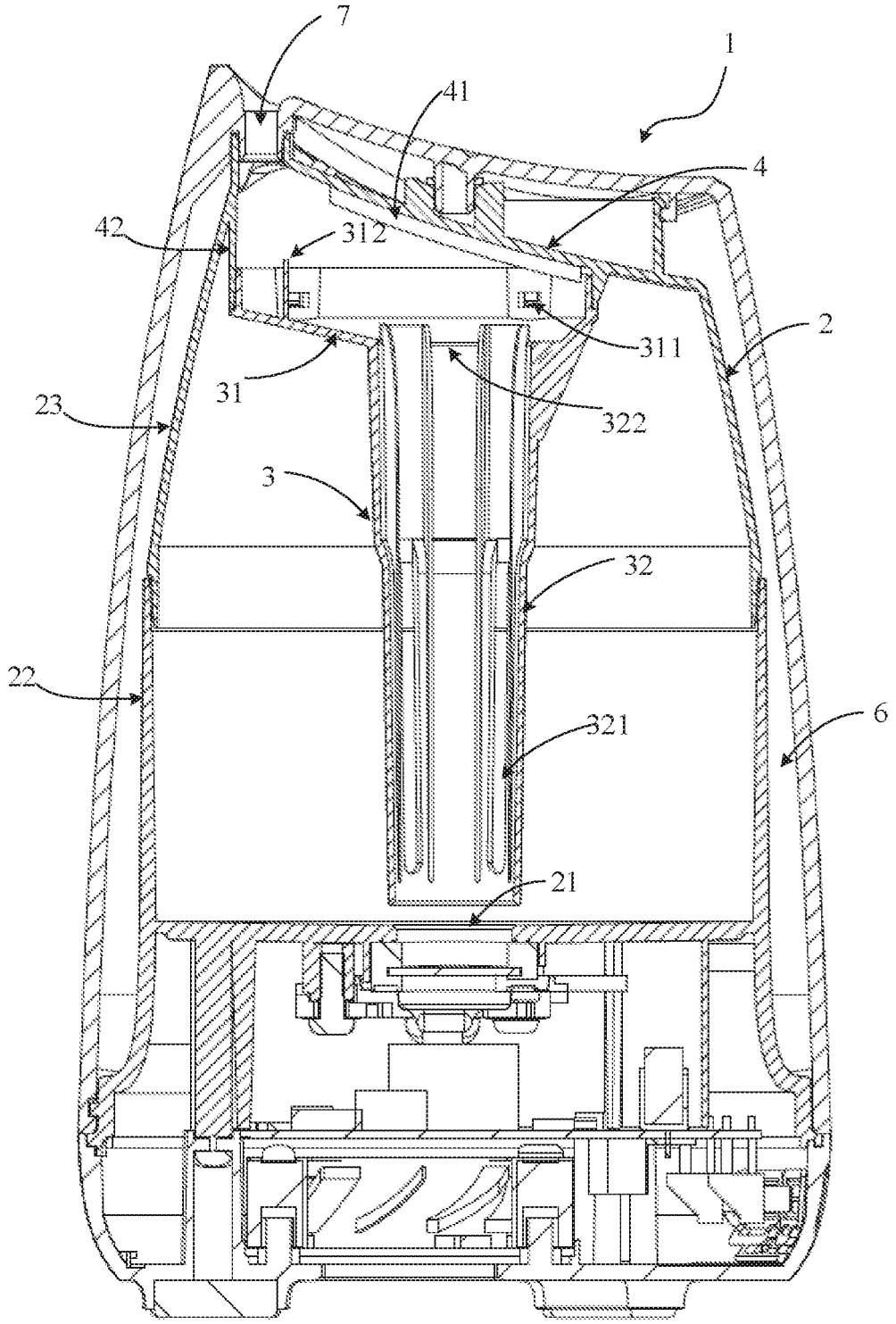
FIG. 1 is a cross-sectional view of an atomization humidifier according to one embodiment of the present disclosure.
Figure 2:
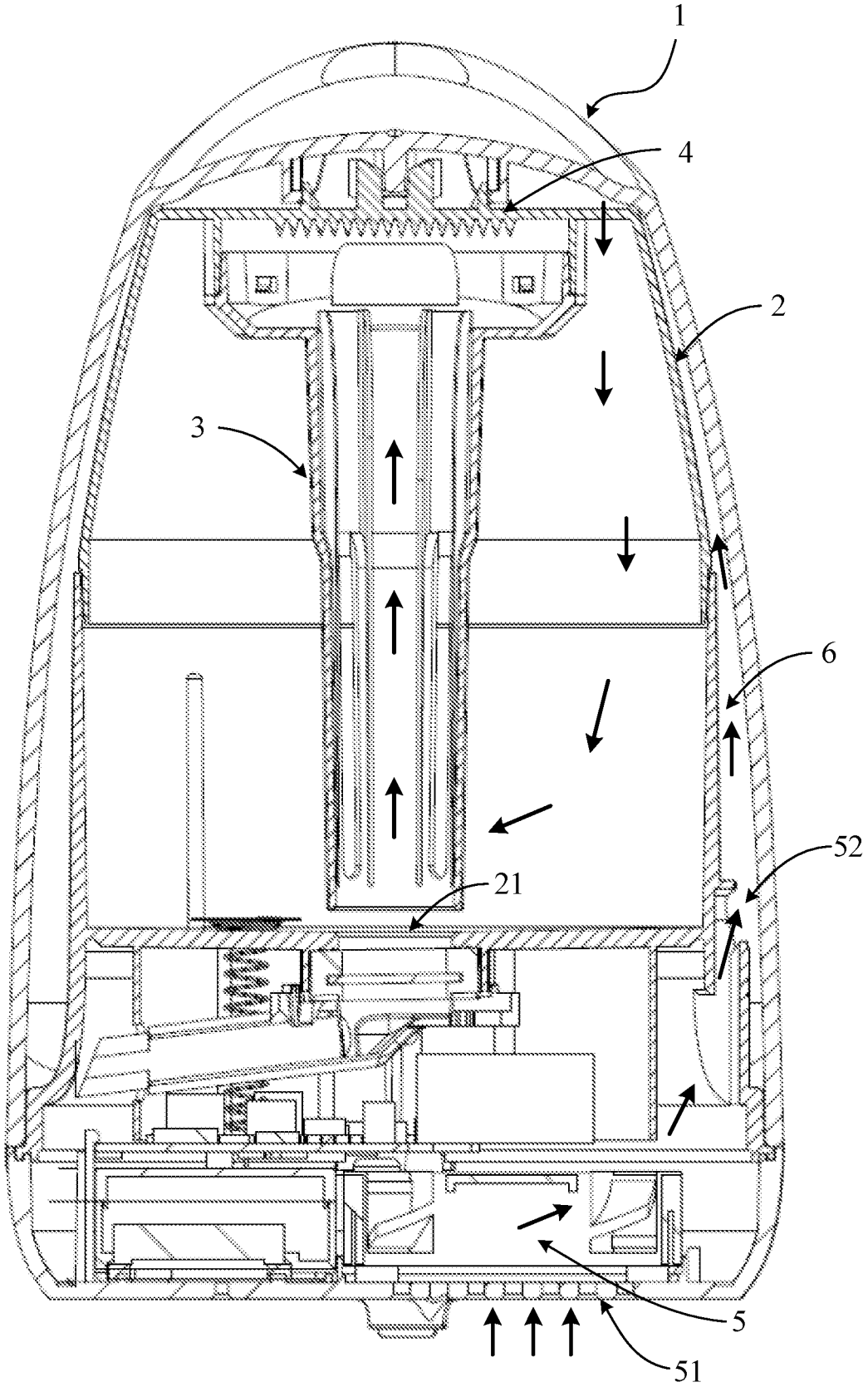
FIG. 2 is a cross-sectional view of the atomization humidifier according to one embodiment of the present disclosure.

As shown in FIG. 1 and FIG. 2, the present disclosure provides an atomization humidifier. The atomization humidifier includes a main body 1 of the atomization humidifier and an atomizing chamber 2 arranged in the main body 1. The atomizing chamber 2 is specifically worked as a water tank and an atomizing working space of the atomization humidifier in the embodiment. The atomizing chamber 2 includes an atomizing generator 21. The atomizing generator 21 has a transducer, and the transducer oscillate water in the atomizing chamber 2 with high frequency to make it atomized. An atomizing air channel 3 is arranged on the atomizing generator 21. A flow guide plate 4 is obliquely arranged on a top end of the atomizing air channel 3. A water inlet 31 is arranged on an upper end of the atomizing air channel 3. An opening of the water inlet 31 is upward. A lower end of the atomizing air channel 3 is an air guide tube 32 with hollow vacancies 321.

The water vapor atomized by the transducer is formed in the atomizing air channel 3, and air is blown into the atomizing air channel 3 from the hollow vacancies 321 of the air guide tube 32, and the formed water vapor is discharged from the vapor outlet 7 and enter a room to increase indoor air humidity. Some large particles of water droplets touch an inner wall of the air guide tube 32 and the inclined flow guide plate 4 to condense into water droplets and return to the atomizing chamber 2 through the inner wall of the air guide tube 32. In this way, the water vapor atomized by the transducer is confined in the atomizing air channel 3 when it is generated. After air convection, some large particles of water droplets are recovered, and most of the water vapor is discharged from the vapor outlet 7 to enter the room, which greatly improves atomization efficiency of the atomization humidifier.

Figure 4:
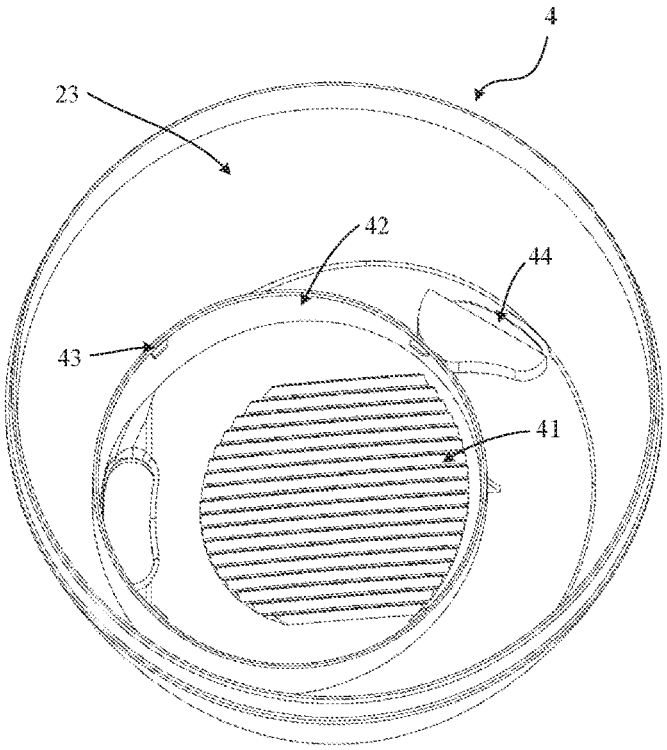
FIG. 4 is a schematic structural diagram of a flow guide plate of the atomization humidifier according to one embodiment of the present disclosure.

Water columns excited by the transducer sprays upward continuously. When a height of the water columns exceeds 10 mm, the water columns dispersed into water droplets, and the water droplets are ejected upward in a divergent manner. Conventional humidifiers do not have a flow guide plate 4, so that the large particles of water droplets drip directly into the water tank, which causes a sound of water droplets to become a main noise source of the humidifier. In the embodiment, the flow guide plate 4 has functions of fluid accumulation and drainage. When the large particles of water droplets are sprayed onto the flow guide plate 4, due to tension, the large particles of water droplets attach to the flow guide plate 4. The water droplets gradually increase and converge into a water flow and flow down to a side of the flow guide plate 4, and then return to the water stored in the atomizing chamber 2 through the atomizing air channel 3, thereby preventing a generation of water droplet noise. Further, in order to better drain the large particles of water droplets, and further reduce beating sounds of the water droplets on the flow guide plate 4, the flow guide plate 4 of the present disclosure includes a sawtooth portion 41. As shown in FIGS. 2 and 4, the sawtooth portion 41 lades strip-shaped triangular sawtooth protruding from a bottom surface of the flow guide plate 4. And a texture direction of the strip-shaped triangular sawtooth is an inclined direction of the flow guide plate 4, so as to drain the water flow. The large particles of water droplets are sputtered onto the triangular sawtooth of the flow guide plate 4, and a slope of the triangular sawtooth increases contact time of the water droplets, delays release time of kinetic energy of the water droplets during a water droplet collision process, and changes positive tapping of the water droplets to a lateral force, which reduces a collision sound. In this embodiment, the reasonable configuration of shape and smoothness of the triangular sawtooth is also the key to reducing the collision sound. To be specific, a pitch between the triangular sawtooth is 1-2 mm, and a height of the triangular sawtooth is 1-3 mm. Further, a 6-level finish of the triangular sawtooth is applied. The noise of the atomization humidifier of the present disclosure in this configuration reaches 24 dB, which is far less than the industry demand of 38 dB.

A portion of the flow guide plate 4 corresponding to the water inlet 31 extends downward to from a side wall 42 of the flow guide plate 4. The side wall 42 of the flow guide plate 4 cooperates with the water inlet 31 to fix the atomizing air channel 3 and introduces water flows into the water inlet 31. The water inlet 31 is an annular wall with an inner diameter larger than the air guide tube 32. The side wall 42 of the flow guide plate 4 directly contacts an outer wall of the water inlet 31. The side wall 42 of the flow guide plate 4 includes a plurality of buckles 43 protruded from the side wall 42. Slots 311 corresponding to the buckles 43 are disposed on the water inlet 31 to facilitate installation, detachment, and cleaning of the atomizing air channel 3.

In order to make the flow guide plate 4 achieve better effusion and drainage, an included angle between the flow guide plate 4 and a horizontal plane ranges from 10-45 degrees. Preferably, the included angle of the flow guide plate 4 and the horizontal plane in the embodiment ranges from 15-30 degrees. Further, the included angle is specifically set to 20 degrees.

Some large particles of water droplets may slap on a wall of the vapor outlet 7 or close to the vapor outlet 7, which leads to water droplets to be sprayed outward at the vapor outlet 7. Thus, a baffle 312 corresponding to the vapor outlet 7 of the atomization humidifier is arranged on the water inlet 31 to reduce the splash of the large particles of water droplets to an outside of the vapor outlet 7.

Figure 3:
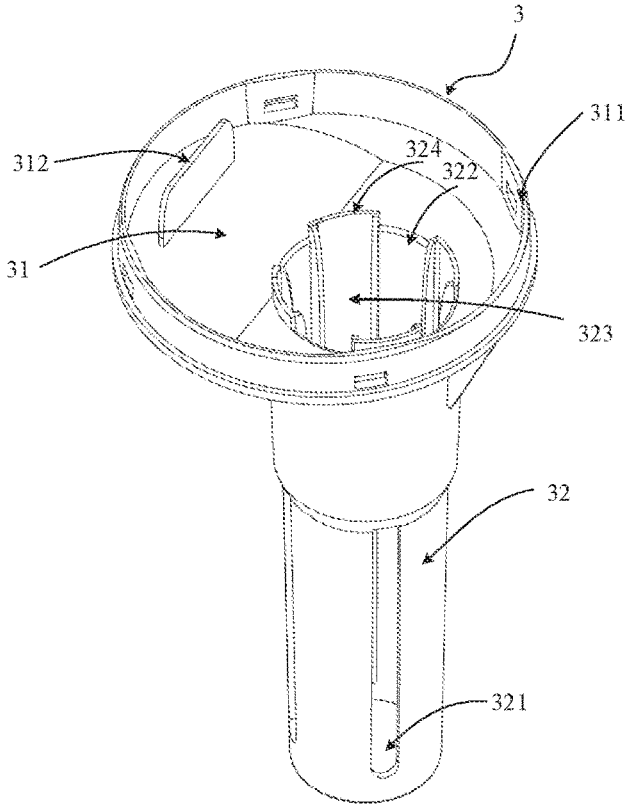
FIG. 3 is a schematic structural diagram of an atomizing air channel of the atomization humidifier according to one embodiment of the present disclosure.

Please refer to the schematic structural diagram of the atomizing air channel shown in FIG. 3, a bottom portion of the water inlet 31 is obliquely arranged, so that the atomizing air channel 3 is funnel-shaped, and the lowest position of the water inlet 31 is an upper end through hole of the air guide tube 32.

Gutters 322 are provided in the air guide tube 32 along an axial direction of the air guide tube 32. The gutters 322 run through the air guide tube 32 and are alternately arranged with the hollow vacancies 321 along a peripheral direction of the air guide tube 32. Thus, the water flow condensed from the flow guide plate 4 flows into the water inlet 31, and then flows from the gutters 322 of the air guide tube 32 into the water stored in the atomizing chamber 2. The hollow vacancies 321 are alternately arranged with the gutters and do not interfere with each other, so that they do not affect the air convection and do not affect the humidification of the atomization humidifier.

In the embodiment, the hollow vacancies 321 are arranged at a lower side of the air guide tube 32. Air guide grooves 323 are arranged on an upper side of the air guide tube 32 corresponding to the hollow vacancies 321. The air guide grooves 323 extend to a connection point of the air guide tube 32 and the water inlet 31 and protrude outward to form water blocking portions 324. The water blocking portions 324 prevent the water from flowing into the air guide tube 32 from the air guide grooves 323. The air guide grooves 323 are alternately arranged with the gutters 322 along the peripheral direction of the air guide tube 32. Further, partition plates are arranged on two sides of the gutters 322, so that the downward water flow and the upward air flow do not interfere with each other and are completely independent from each other. As water level changes, a height of the air intake of the hollow vacancies 321 change accordingly. In order to ensure that the water vapor being taken out in time, generally, the hollow vacancies 321 are configured to be longer. In the embodiment, a shell of the atomizing chamber 2 includes an upper shell 23 and a lower shell 22. The upper shell 23 and the flow guide plate 4 are integrally formed, and the water level of the atomizing chamber 2 is no more than a height of the lower shell 22. Thus, a height of the hollow vacancies 321 is configured to be equal to the height of the lower shell 22, or slightly higher than the height of the lower shell 22 to ensure that the water does not flow through the hollow vacancies 321, and the hollow vacancies 321 have part of the air intake space.

A housing of the atomization humidifier is arranged outside the atomizing chamber 2. An air supply chamber 6 is formed between the housing and an outer wall of the atomizing chamber 2. A ventilation hole 51 is arranged on a bottom portion of the atomization humidifier, and the ventilation hole 51 is a through hole. A fan 5 is arranged on the ventilation hole 51. The fan 5 corresponds to an air inlet 52 of the air supply chamber 6 to send air into the air supply chamber 6. And an air outlet 44 of the air supply chamber 6 is arranged at the flow guide plate 4 on the top of the atomization humidifier to send air into the atomizing chamber 2 from top to bottom. Then the air enters the atomizing air channel 3 from the hollow vacancies 321, and carries the water vapor from the bottom to the top through the vapor outlet 7 and enters the room.

The atomization humidifier provided by the present disclosure realizes water vapor concentration of the atomization humidifier by setting the atomizing air channel arranged on the atomizing generator, which improves an atomizing efficiency of the atomization humidifier by optimized structure, and is low in cost and good in atomizing effect. The exquisite design of the atomizing air channel and the flow guide plate greatly reduces noise of the atomization humidifier and improves the user's experience.

The above description is only optional embodiments of the present disclosure and is not intended to limit the present disclosure. Any modification, equivalent replacement, and improvement made within the spirit and principle of the present disclosure shall be included in the protection scope of the present disclosure.

What is claimed is:

1. An atomization humidifier, comprising a main body and an atomizing chamber arranged in the main body; wherein the atomizing chamber comprises an atomizing generator, an atomizing air channel is arranged on the atomizing generator; a flow guide plate is obliquely arranged on a top end of the atomizing air channel;

wherein a water inlet is arranged on an upper end of the atomizing air channel; an opening of the water inlet is upward; a lower end of the atomizing air channel is an air guide tube with hollow vacancies.

2. The atomization humidifier according to claim 1, wherein the flow guide plate comprises a sawtooth portion; the sawtooth portion is strip-shaped triangular sawtooth protruding from a bottom surface of the flow guide plate, and a texture direction of the strip-shaped triangular sawtooth is an inclined direction of the flow guide plate.

3. The atomization humidifier according to claim 1, wherein a portion of the flow guide plate corresponding to the water inlet extends downward to form a side wall of the flow guide plate; the side wall of the flow guide plate cooperates with the water inlet to fix the atomizing air channel and introduces water flows into the water inlet.

4. The atomization humidifier according to claim 1, wherein the atomization humidifier further comprises a housing; an air supply chamber is formed between the housing and an outer wall of the atomizing chamber.

5. The atomization humidifier according to claim 4, wherein the air supply chamber comprises an air inlet and an air outlet; a fan is arranged on the air inlet; the air outlet is arranged at the flow guide plate.

6. The atomization humidifier according to claim 1, wherein a baffle corresponding to a vapor outlet of the atomization humidifier is arranged on the water inlet.

7. The atomization humidifier according to claim 1, wherein gutters are provided in the air guide tube along an axial direction of the air guide tube.

8. The atomization humidifier according to claim 7, wherein the gutters run through the air guide tube and are alternately arranged with the hollow vacancies along a peripheral direction of the air guide tube.

9. The atomization humidifier according to claim 8, wherein the hollow vacancies are arranged at a lower side of the air guide tube; air guide grooves are arranged on an upper side of the air guide tube corresponding to the hollow vacancies; the air guide grooves extend to a connection point of the air guide tube and the water inlet and protrude outward to form water blocking portions.

10. The atomization humidifier according to claim 9, wherein partition plates, are arranged on two sides of the gutters.

* * * * *